US011597568B2

(12) United States Patent
Pastrana

(10) Patent No.: US 11,597,568 B2
(45) Date of Patent: Mar. 7, 2023

(54) CHILD RESISTANT PACKAGING WITH MULTIPLE STORAGE COMPARTMENTS WITH HINGED COVERS

(71) Applicant: Mhariel Valmadrid Pastrana, Sycamore, IL (US)

(72) Inventor: Mhariel Valmadrid Pastrana, Sycamore, IL (US)

(73) Assignee: J.L. Clark LLC, Rockford, IL (US)

( * ) Notice: Subject to any disclaimer, the term of this patent is extended or adjusted under 35 U.S.C. 154(b) by 9 days.

(21) Appl. No.: 17/200,290

(22) Filed: Mar. 12, 2021

(65) Prior Publication Data

US 2021/0300641 A1 Sep. 30, 2021

Related U.S. Application Data

(60) Provisional application No. 63/001,853, filed on Mar. 30, 2020.

(51) Int. Cl.
*B65D 50/06* (2006.01)
*B65D 43/16* (2006.01)

(52) U.S. Cl.
CPC ..... *B65D 50/06* (2013.01); *B65D 43/162* (2013.01); *B65D 2215/04* (2013.01)

(58) Field of Classification Search
CPC ... B65D 50/06; B65D 43/162; B65D 2215/04
See application file for complete search history.

(56) References Cited

U.S. PATENT DOCUMENTS

| | | | | |
|---|---|---|---|---|
| 2,353,629 | A | 7/1944 | Apfelbaum | |
| 3,888,350 | A | 6/1975 | Horvath | |
| 3,949,898 | A | 4/1976 | Patel et al. | |
| 4,113,098 | A | 9/1978 | Howard | |
| 4,364,488 | A | 12/1982 | Anjou | |
| 4,401,210 | A | 8/1983 | Anjou | |
| 4,591,074 | A | 5/1986 | Kennings | |
| 6,953,131 | B2 | 10/2005 | Devine | |
| 7,086,556 | B1 | 8/2006 | Truelove-Cranor | |
| 7,377,385 | B2 * | 5/2008 | Giannini | B65D 5/38 229/125.125 |
| 7,882,953 | B2 | 2/2011 | Heller et al. | |
| 7,946,450 | B2 | 5/2011 | Gelardi et al. | |
| 8,091,709 | B2 | 1/2012 | Gnepper | |
| 8,453,840 | B2 | 6/2013 | Wharton | |

(Continued)

FOREIGN PATENT DOCUMENTS

JP 2003192055 A 7/2003

*Primary Examiner* — Shawn M Braden
(74) *Attorney, Agent, or Firm* — Reinhart Boemer Van Deuren P.C.

(57) ABSTRACT

A child proof container includes an outer shell defining an opening. An internal cartridge defines first and second storage cavities. The internal cartridge is slidable within the outer shell between an inserted position and a withdrawn position. A first cover is hingedly attached to the internal cartridge by a first hinge. The first cover pivots about the first hinge between a closed position for covering the first storage cavity and an open position for providing access to the first storage cavity. The first cover is attached to the internal cartridge such that the first cover cannot pivot to the open position until the internal cartridge is in the withdrawn position.

16 Claims, 9 Drawing Sheets

(56) References Cited

U.S. PATENT DOCUMENTS

| | | | | |
|---|---|---|---|---|
| 8,474,624 | B2 * | 7/2013 | Cronin | B65D 50/046 220/281 |
| 8,616,376 | B2 | 12/2013 | Cronin | |
| 8,672,134 | B2 | 3/2014 | Sprada et al. | |
| 8,746,444 | B2 * | 6/2014 | Dehlin | B65D 5/38 220/345.4 |
| 10,513,370 | B1 * | 12/2019 | Goossens | B65D 5/5028 |
| 2004/0055903 | A1 | 3/2004 | Nishimura | |
| 2007/0261984 | A1 * | 11/2007 | Gelardi | B65D 75/327 206/531 |
| 2009/0184023 | A1 * | 7/2009 | Brollier | B65D 83/0463 206/469 |
| 2011/0225936 | A1 * | 9/2011 | Ortenzi | B65D 50/06 206/438 |
| 2015/0224026 | A1 * | 8/2015 | Davidson | B65D 25/10 220/315 |

* cited by examiner

CHILD RESISTANT PACKAGING WITH MULTIPLE STORAGE COMPARTMENTS WITH HINGED COVERS

CROSS-REFERENCE TO RELATED PATENT APPLICATIONS

This patent application claims the benefit of U.S. Provisional Patent Application No. 63/001,853, filed Mar. 30, 2020, the entire teachings and disclosure of which are incorporated herein by reference thereto.

FIELD OF THE DISCLOSURE

This present disclosure generally relates to containers and more particularly, to handheld containers for product such as candy, medicine, vitamins or other small objects.

BACKGROUND

It is often desirable to have containers for storing various objects be child resistant. This feature is used to prevent children from accidentally coming into contact with and particularly ingesting the contents of the containers. For example, containers for things such as smokeless tobacco, medicine, or other objects are often child resistant.

One test that determines whether a container is considered child resistant is if opening the container requires a multi-step process. For instance, some child resistant containers have threaded lids that require a two-step process to remove the threaded lid from the container bottom. The two-step process requires first axially pressing the threaded lid toward the container bottom and then second rotationally twisting the threaded lid relative to the container bottom. Accordingly, with such containers, the first step is axially pressing and the second step is rotationally twisting (i.e. unthreading). Containers for other products may contain products, for example paper, with liquids absorbed thereon. The two-step opening process prevents one single action from inadvertently opening such containers and mistakenly spilling the contents. Accordingly, a user of the container can safely and securely store the product in such multi-step opening containers until they reach a proper trash receptacle.

Another problem is many objects may be used but then waste is produced that is not desirable to be placed in the user's pocket. For example, some smokeless tobacco is in pouch form. Once used, however, the moist pouch should be disposed of. If there is no available location to dispose of the used pouch, this can be problematic. Further, putting the moist pouch back in the container with the rest of the unused pouches is not desirable.

Gum, such as medicinal gum that should not be ingested by children, can have similar problems as pouches of smokeless tobacco.

The present disclosure relates to improvements in the container art.

SUMMARY

The present application provides a new and improved container. The new and improved container provides a new and improved internal cartridge cooperating with an outer shell to store product in the container. The internal cartridge slidingly traverses in and out of the outer shell to move from an inserted state to a withdrawn state and from a withdrawn state to an inserted state. In some instances, the internal cartridge can provide multiple storage compartments for product storage such that the multiple storage compartments are at least partially covered by respective covers. In some instances the covers are hingedly attached to the internal cartridge to pivot from closed to open states and from open to closed states to at least partially cover respective storage compartments. In some instances at least one storage compartment can be completely covered with a cover when the internal cartridge is withdrawn from the outer shell. With the internal cartridge inserted in the outer shell, multiple steps are required to open the covers of the storage compartments to access the product therein.

In one example, the present disclosure provides a child proof container. The child proof container includes an outer shell defining an opening. An internal cartridge defines first and second storage cavities. The internal cartridge is slidable within the outer shell between an inserted position and a withdrawn position. A first cover is hingedly attached to the internal cartridge by a first hinge. The first cover pivots about the first hinge between a closed position for covering the first storage cavity and an open position for providing access to the first storage cavity. The first cover is attached to the internal cartridge such that the first cover cannot pivot to the open position until the internal cartridge is in the withdrawn position.

In an example, the first cover is received, at least in part, within the outer shell when the first cover is in the closed position and the internal cartridge is in the inserted position.

In an example, a stop arrangement is between the outer shell and the internal cartridge. The stop arrangement limits the amount of relative sliding travel between the outer shell and the internal cartridge. The stop arrangement defines the withdrawn position whereat the first cover may be transitioned from the closed position to the open position.

In an example, the first hinge is external of the outer shell when the internal cartridge is in the inserted position with the first cover received within the outer shell.

In an example, the internal cartridge is slidable within the outer shell along a sliding axis. The first hinge is substantially perpendicular to the sliding axis. By substantially it is meant plus or minus 20 degrees of perpendicular.

In an example, the internal cartridge is slidable within the outer shell along a sliding axis. The first hinge is substantially perpendicular to the sliding axis.

In an example, the internal cartridge includes bottom and a peripheral wall extending outward from an inner side of the bottom. The internal wall extends outward from the inner side of the bottom. The internal wall cooperates with the peripheral wall to define the first and second storage cavities.

In an example, the first cover and the internal cartridge include a catch arrangement that snap engages to secure the first cover in the closed position when the internal cartridge is in the withdrawn position.

In an example, the first cover abuts a top of the internal wall portion in the closed position.

In an example, a second cover is hingedly attached to the internal cartridge by a second hinge. The second cover pivots between a closed position and an open position about the second hinge. The open position provides greater access to the second storage cavity than the closed position. The second cover is attached to the internal cartridge such that the second cover cannot pivot to the open position until the internal cartridge is in the withdrawn position.

In an example, the first and second hinges are co-axial.

In an example, the outer shell includes a sidewall defining an abutment end. The abutment end defines the opening of the outer shell. The internal cartridge and first and second covers define a cartridge abutment that abuts the abutment end of the outer shell when the internal cartridge is in the inserted position and the first and second covers are in the closed position.

In an example, the abutment end of the outer shell and cartridge abutment define an interface. An outer periphery of the abutment end and an outer periphery of the cartridge abutment are the same such that the outer periphery of the abutment end transitions into the outer periphery of the cartridge abutment.

In an example, the internal cartridge includes a bottom and a peripheral wall extending outward from an inner side of the bottom. The internal wall extends outward from the inner side of the bottom. The peripheral wall has a step separating a shorter wall portion of the peripheral wall from a taller wall portion of the peripheral wall. The first cover has a top surface. The top surface aligns with a top of the taller wall portion. A bottom side of the first cover abuts a top of the shorter wall portion.

In an example, the shorter wall portion includes a notch formed in the top thereof. The notch is exposed from an outer side of the peripheral wall. The first cover extends over the notch.

In an example, a volume of the first storage cavity is smaller than the second storage cavity.

In an example, the second storage cavity has a first portion that remains within the outer shell when the internal cartridge is in the withdrawn position and a second portion that is external to the outer shell when the internal cartridge is in the withdrawn position. The second cover covers, at least part, of the first portion of the second storage cavity when in the closed position. The first portion of the second storage cavity is in direct fluid communication with the second portion of the second storage cavity when the second cover is in the closed position, such that product within the second portion of the second storage cavity can transition from the second portion to the first portion when the second cover is in the closed position.

Other aspects, objectives and advantages of the present disclosure will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present disclosure, together with the description, serve to explain the principles of the disclosure. In the drawings.

While the present disclosure will be described in connection with certain examples, there is no intent to limit it to those examples. On the contrary, the intent is to cover all alternatives, modifications and equivalents as included within the spirit and scope of the present disclosure as defined by the appended claims.

DETAILED DESCRIPTION

Figure 1:
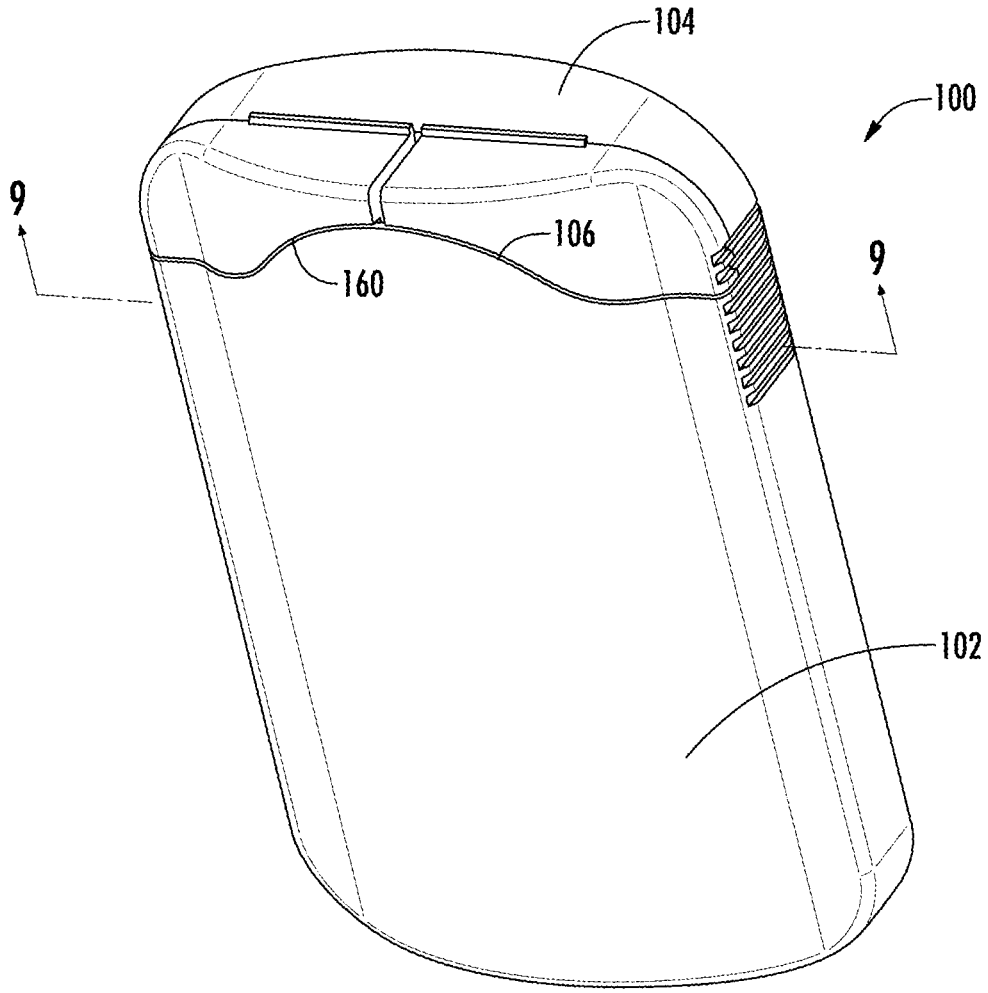
FIG. 1 is an isometric front view of a container according to the teachings of one example of the present disclosure.

Turning now to FIG. 1, a front view one example of a container 100 according to the present disclosure is illustrated. The container 100 includes an outer shell 102 that receives therein an internal cartridge 104. The internal cartridge 104 is slidably received into the outer shell 102 until it contacts an abutment end 106 of the outer shell 102 which acts as a stop to prevent the internal cartridge 104 from sliding any further into the shell 100. Thus, in FIG. 1, the internal cartridge 104 is in an inserted position according to the teachings of the present disclosure.

Figure 2:
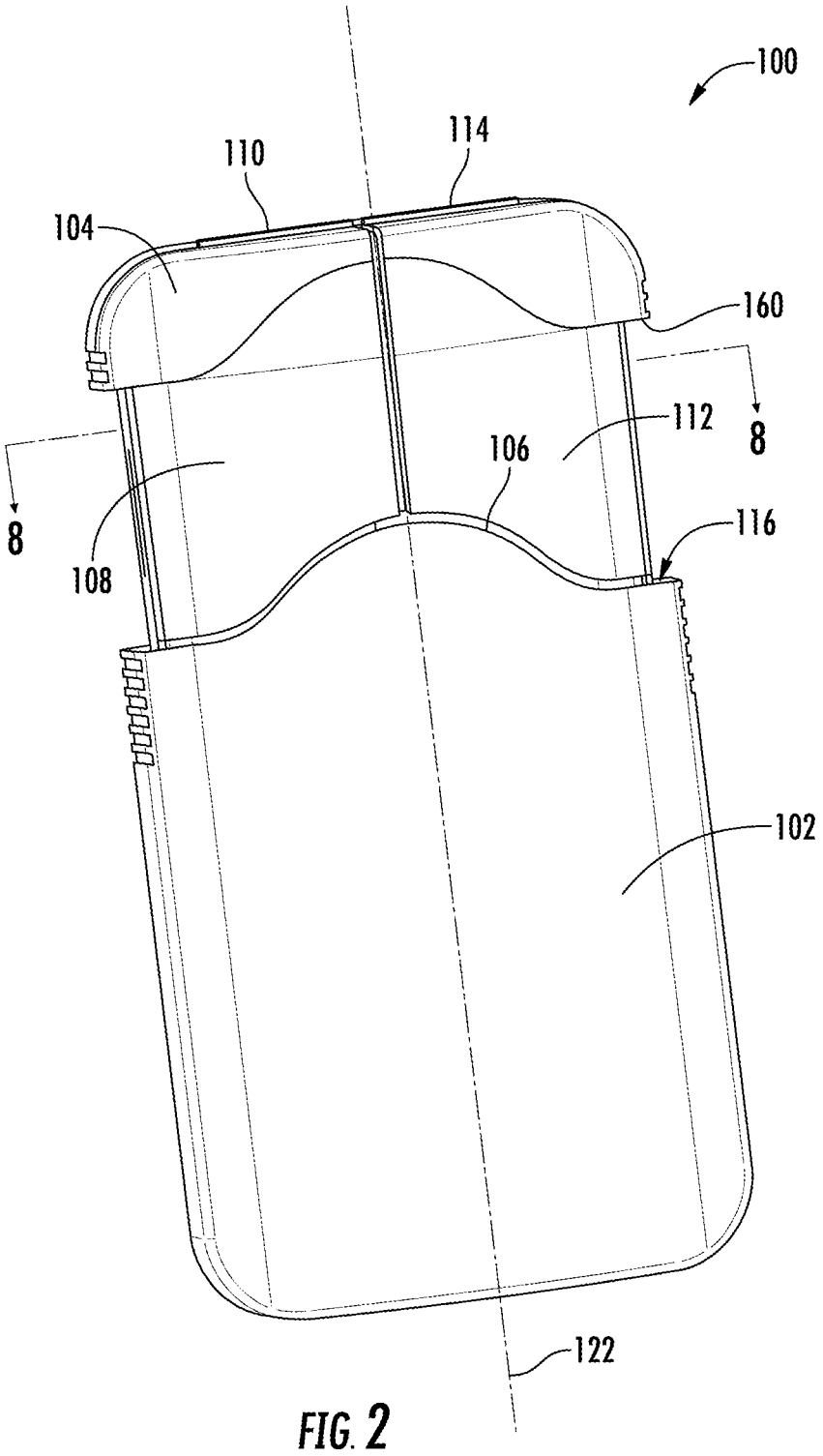
FIG. 2 is an isomeric front view of the container in FIG. 1 with an internal cartridge in a withdrawn position relative to the outer shell.

FIG. 2 illustrates another front view of the container 100. The internal cartridge 104 has been slidingly withdrawn along a sliding axis 122 from an opening 116 defined by the outer shell 102 and particularly abutment end 106. A sliding axis 122 extends longitudinally through a center of the container 100. A first cover 108 is pivotably attached to the internal cartridge 104 by a first hinge 110. A second cover 112 is pivotably attached to the internal cartridge 104 by a second hinge 114. When in either the withdrawn or inserted positions, the first and second hinges 110, 114 are located external to the outer shell 102 and are substantially perpendicular to the sliding axis 122. By substantially perpendicular it is meant plus or minus 10 degrees. In FIG. 2, the first cover 108 and the second cover 112 are shown in their closed positions.

Figure 3:
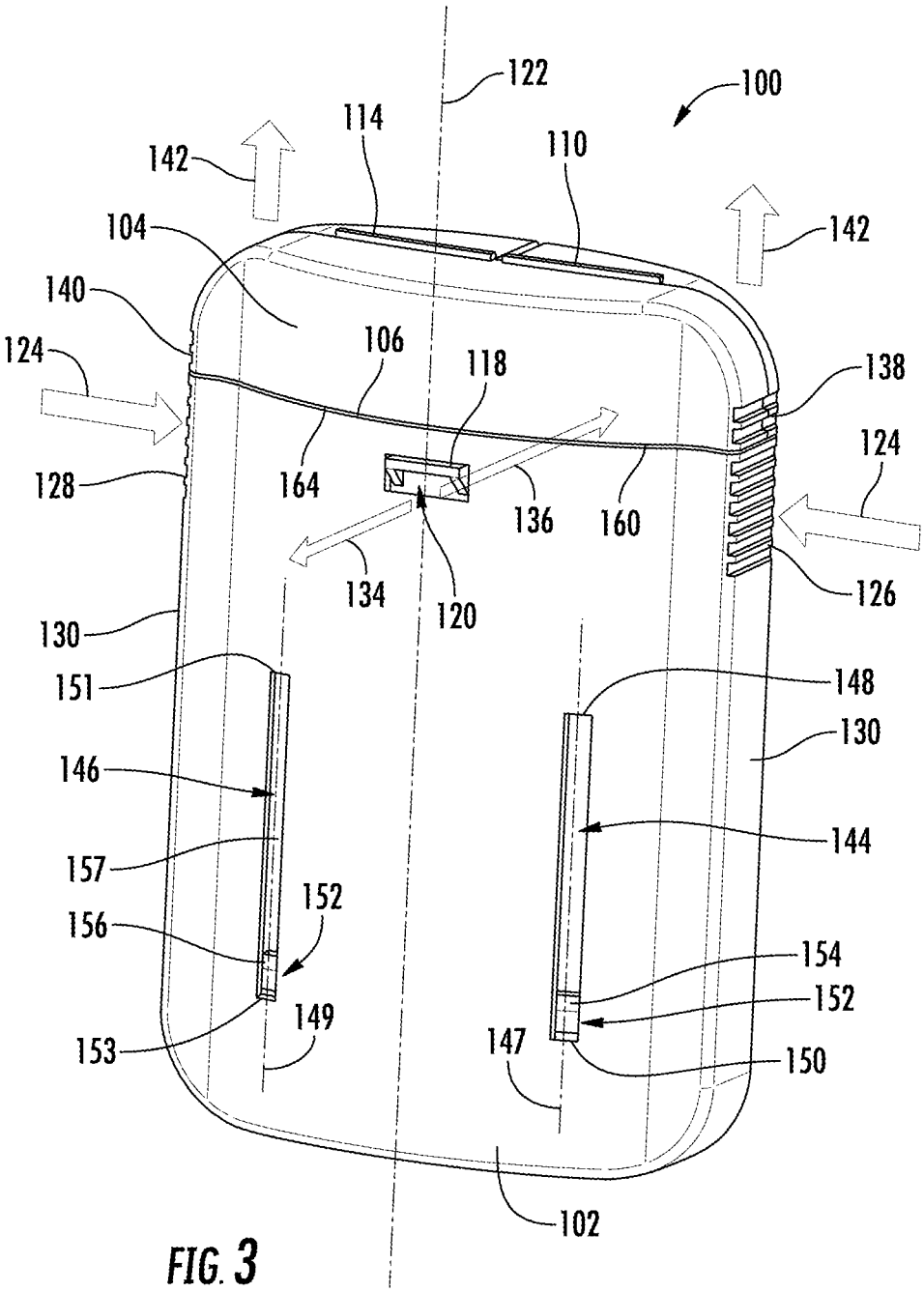
FIG. 3 is an isometric rear view of the container of FIG. 1.

Turing to FIG. 3, a rear view of the container 100 is shown with the internal cartridge 104 in the inserted state as in FIG. 1. The internal cartridge 104 is maintained in the inserted position and inhibited from sliding to the withdrawn position (FIG. 2) because of a catch 118 that is received in an aperture 120 and abuts with a wall defining the aperture 120 when the internal cartridge 104 is in the inserted state. The aperture 120 is defined by the outer shell 102. It can now be readily appreciated that the catch 118 must be disengaged from the wall and removed from the aperture 120 in order for the internal cartridge 104 slide relative to the outer shell and to be slidingly withdrawn from the opening 116 of the outer shell 102 to reach its withdrawn state as in FIG. 2.

Accordingly, to disengage the catch 118, a user may hold the outer shell 102 in a first hand and apply a squeezing pressure 124 in a first and a second opposed directions at a first outer shell grip 126 and a second outer shell grip 128 located on opposite sides of the sliding axis 122 and the outer shell 102. The squeezing pressure 124 compresses a peripheral walls 130 towards one another and the sliding axis 122. Compression of the peripheral walls 130, and particularly the first and second shell grips 126, 128, simultaneously causes the outer shell 102 to expand in directions 134 and 136. The directions 134, 136 are generally perpendicular to the squeezing pressure 124 so as to remove the catch 118 from the aperture 120. By "generally," it is meant from between 70 to 110 degrees, that is 20 degrees plus or minus of perpendicular. Gaps 138 (FIG. 9) between the peripheral wall 130 of the outer shell 102 and the internal cartridge 104 permit the squeezing deformation of the outer shell 102.

Once the squeezing pressure 124 has released the catch 118 from the aperture 120, a user may hold the internal cartridge 104 with a second hand at third grip 138 and fourth grip 140 and apply a pulling force 142 to slidingly withdraw the internal cartridge 104 from opening 116 of the outer shell 102.

Catch 118 and aperture 120 could be reversed in other examples. Further, the catch and aperture arrangement may generally be referred to as a catch arrangement interposed between the cartridge 104 and shell 102.

The outer shell 102 defines a first groove 144 and a second groove 146 that are spaced apart from one another on opposite sides of the sliding axis 122. The first groove 144 defines an open limit 148 and a closed limit 150 and the second groove 146 defines an open limit 151 and a closed limit 153.

The first and second grooves 144, 146 each respectively have a major axis 147, 149 that extend parallel to the sliding axis 122. The first and second grooves 144, 146, extend a first distance 158 defined by the length of the first and the second grooves 144, 146 along each of their major axes 147, 149 extending from each respective open limit 148, 151 to each respective closed limit 150, 153. In some examples, a closed limit is not required.

A first stop 154 and a second stop 156 extend outward from a rear of the internal cartridge 102.

The stops 154, 156 and grooves 144, 146 (and particularly open limits 148, 151) form a stop arrangement 152 between the outer shell 102 and the internal cartridge 104. The stop arrangement 152 limits the amount of relative sliding travel between the outer shell 102 and the internal cartridge 104. In another example, the first and second stops 154 and 156 may be located on and protrude from a back surface 157 of the internal cartridge 104.

It can now be readily appreciated that the first stop 154 and the second stop 156 travel within respective first and second grooves 144 and 146 to limit the distance the internal cartridge 104 may travel as it is withdrawn from the outside shell 102. Once the first stop 154 and the second stop 156 stop contact abutments in the form of corresponding open limits 148, 151 then the internal cartridge 104 has reached its withdrawn state where it has been fully withdrawn and no further withdrawal is permitted, absent significant deformation of one or more components of the container 100. So too, as the internal cartridge 104 is pushed to slidingly reinsert it through the opening 116 (FIG. 2) into the outer shell 102. Its sliding travel may be stopped when the first stop 154 and the second stop 156 contact the respective closed limits 150, 153 of the first and second grooves 144, 146. So too, in the inserted state of the internal cartridge 104, abutment 160 axially abuts the abutment end 106 of the outer shell to form an interface 164.

Figure 4:
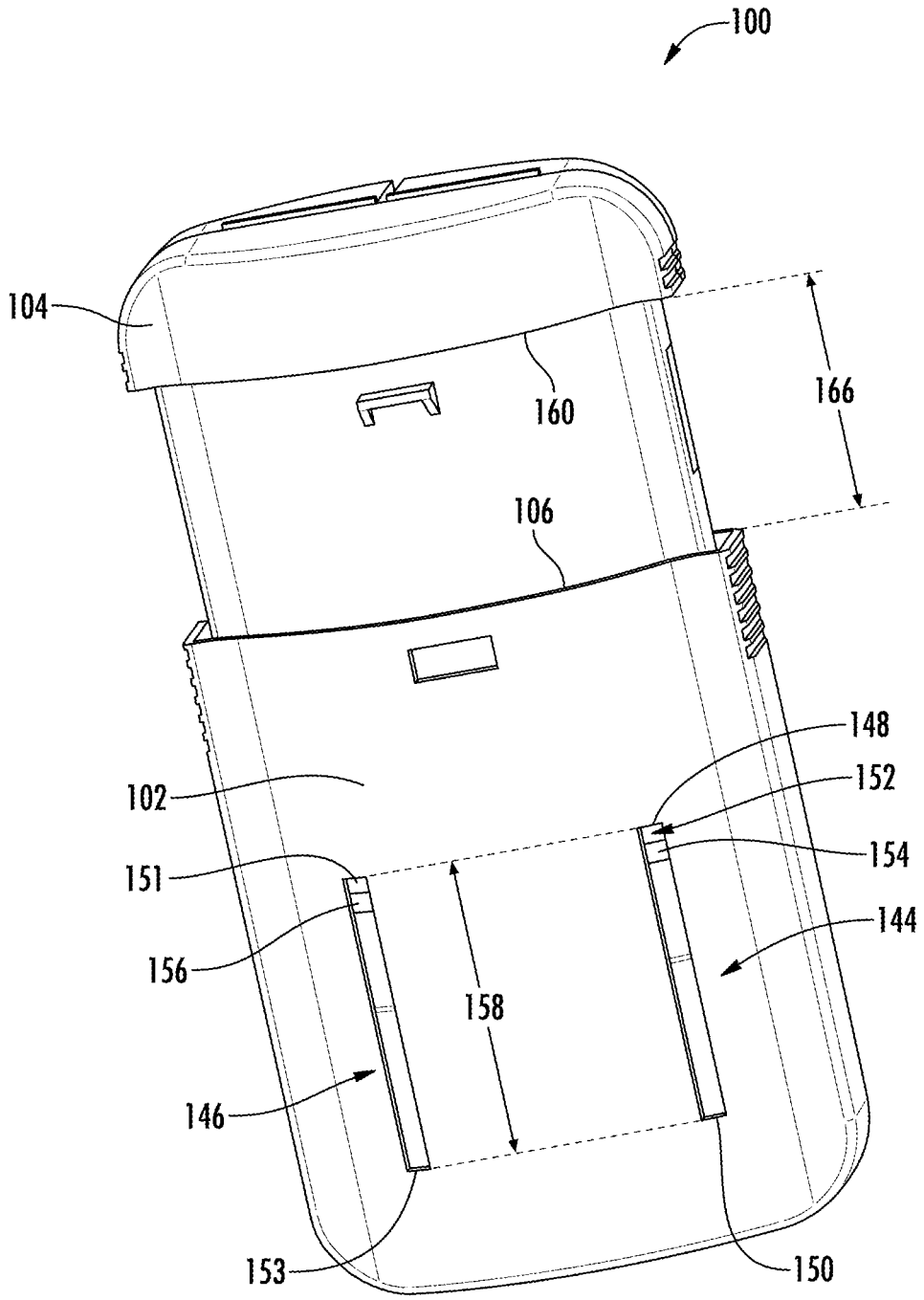
FIG. 4 is an isometric rear view of the container of FIG. 1 with the internal cartridge in the withdrawn position.

Turning now to FIG. 4, a rear view of the container 100 is illustrated with the internal cartridge 104 in the withdrawn state. To move from the inserted to the withdrawn state of the internal cartridge 104, the first and second stops 154, 156 of the stop arrangement 152 travel a first distance 158 from the respective closed limits 150, 153 to contact, that is, abut the respective open limits 148, 151. So too, the cartridge abutment 160 has traveled a second distance 166 from the end 162 of the outer shell 102 as the internal cartridge 104 slides from the inserted state to the withdrawn state. It can be appreciated now that the first distance 158 and the second distance 166 are equal distances. However, in some examples, the length of slots 144, 146 is greater than distance 166.

Figure 5:
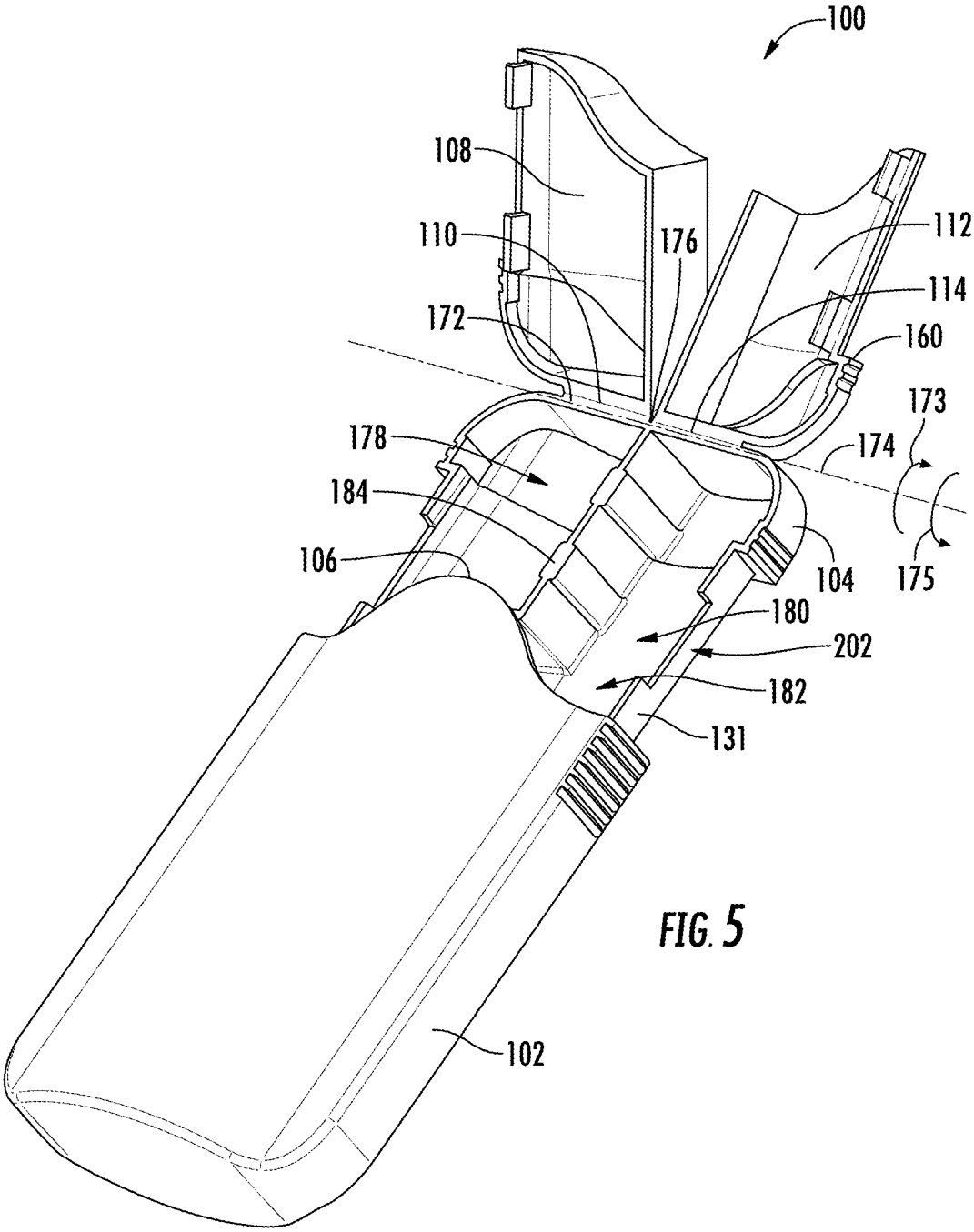
FIG. 5 is an isometric front view of the container of FIG. 1 with the internal cartridge in the withdrawn position and with covers attached to the internal cartridge in their open states.

FIG. 5 illustrates a front view of the container 100 with the internal cartridge 104 in its withdrawn state. The first cover 108 is shown having independently pivoted about a first hinge axis 172 defined by the first hinge 110 in a first rotational direction 173 to open the first cover 108. By independent it is meant that the first cover 108 may be pivoted without moving the second cover 112. In other words, the second cover 112, may remain closed when the first cover 108 is opened.

So too, the second cover 112 is shown after having independently pivoted in the first rotational direction 173, about a second hinge axis 174 defined by the second hinge 114 to open the second cover 112.

In this example, the first and second hinge axis 172, 174 are coaxial and define a common pivot axis 176. In other examples, the first and second hinge axes 172, 174 need not be coaxial nor do they need to be parallel. The first cover 108 and the second cover 112 may be independently pivoted in a second rotational direction 175, opposite the first rotational direction 173 to close one or both (FIG. 6) of the first cover 108 and the second cover 112.

Opening the first cover 108, reveals a first storage cavity 178. Opening the second cover 112 reveals a first portion 180 of a second storage cavity 182.

An internal wall 184 separates the first storage cavity 178 from the first portion 180 of the second storage cavity 182.

The first and second covers 108, 112 are configured such that the first and second covers 108 cannot pivoted to the open position until the internal cartridge 104 is in the withdrawn position. More particularly, the attachment of the first and second covers 108, 112 to the internal cartridge 104 and the length of the first and second covers 108, 112 relative to the abutment 160 are such that the free ends of the first and second covers 108, 112 are removed from the outer shell 102 when the cartridge 104 is in the withdrawn position.

It can now be readily appreciated that the container 100 of this example is constructed to be child resistant. To be child resistant according to this example, the container 100 requires at least two separate actions be performed to transition the internal cartridge 104 to its withdrawn state and yet further actions to open (e.g. rotate) the first and second covers 108, 112.

Additionally, in this example, the container requires a user to apply the first action to be the squeezing pressure 124 applied with one hand while the second action is the use of the other hand to apply the pulling force 142 to pull the internal cartridge 104 in the direction of the sliding axis 122. Accordingly, these two separate actions are understood to make the container 100 child resistant. As will be discussed below, yet further actions are required to open the first and second covers 108, 112.

Figure 6:
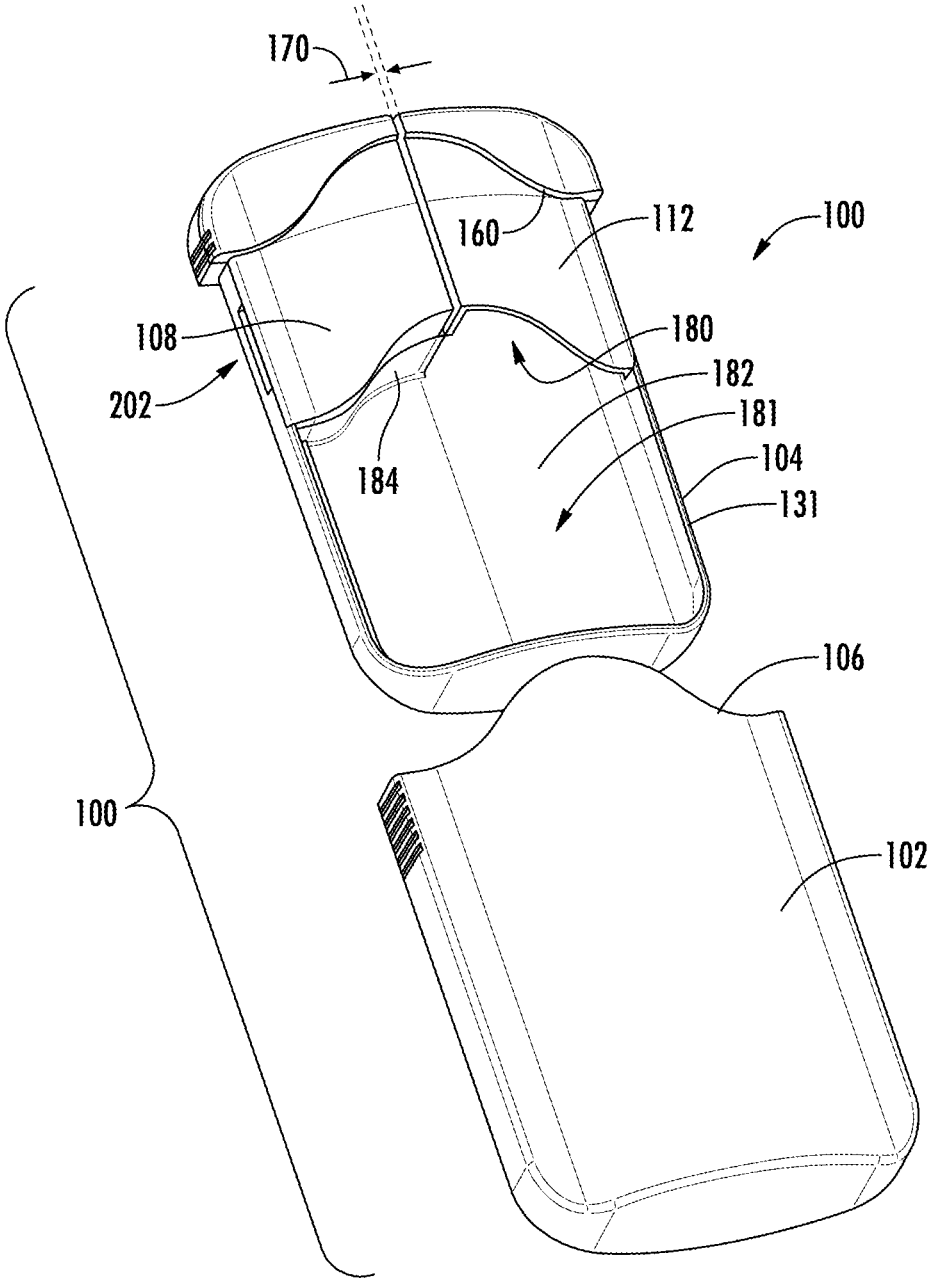
FIG. 6 is an isometric front assembly view of the container of FIG. 1, with the covers in their closed states and the cartridge fully removed from the outer shell.

FIG. 6 illustrates an exploded view of the container 100 with the internal cartridge 104 completely removed from the outer shell 102. The first and second covers 108, 112 are in their closed states. When closed, the first and second covers 108, 112 each abut portions of the internal wall 184 of the internal cartridge 104.

There is a separation 170 defined between the first and second covers 108, 112 to inhibit binding between the covers 108, 112 when transitioning between the open and closed positions to permit each of the first and second covers 108, 112 to independently be opened and closed as desired. Moreover, a second portion 181 of the second storage cavity 182 is visible in this view. This second portion 181 of the second storage cavity 182 generally remains within the outer shell 102 when the internal cartridge 104 is in the withdrawn position (e.g. when stops 154, 156 engage the abutments provided by open limits 148, 151).

When the first and second covers 108, 112 are in their closed positions, the internal cartridge 104 and the first and second covers 108, 112 define the cartridge abutment 160 that abuts the abutment end 106 of the outer shell 102 when the internal cartridge 104 is in the inserted position and the first 108 and second covers 112 are each in their closed positions as shown for example in FIG. 1.

An outer periphery of the abutment end 106 and an outer periphery of the cartridge abutment 160 are the same shape and size such that the outer periphery of the abutment end 106 transitions into the outer periphery of the cartridge abutment 160 with little to no gap or step between at the interface between the abutted components when in the interested position (see e.g. FIGS. 1 and 3).

Figure 7:
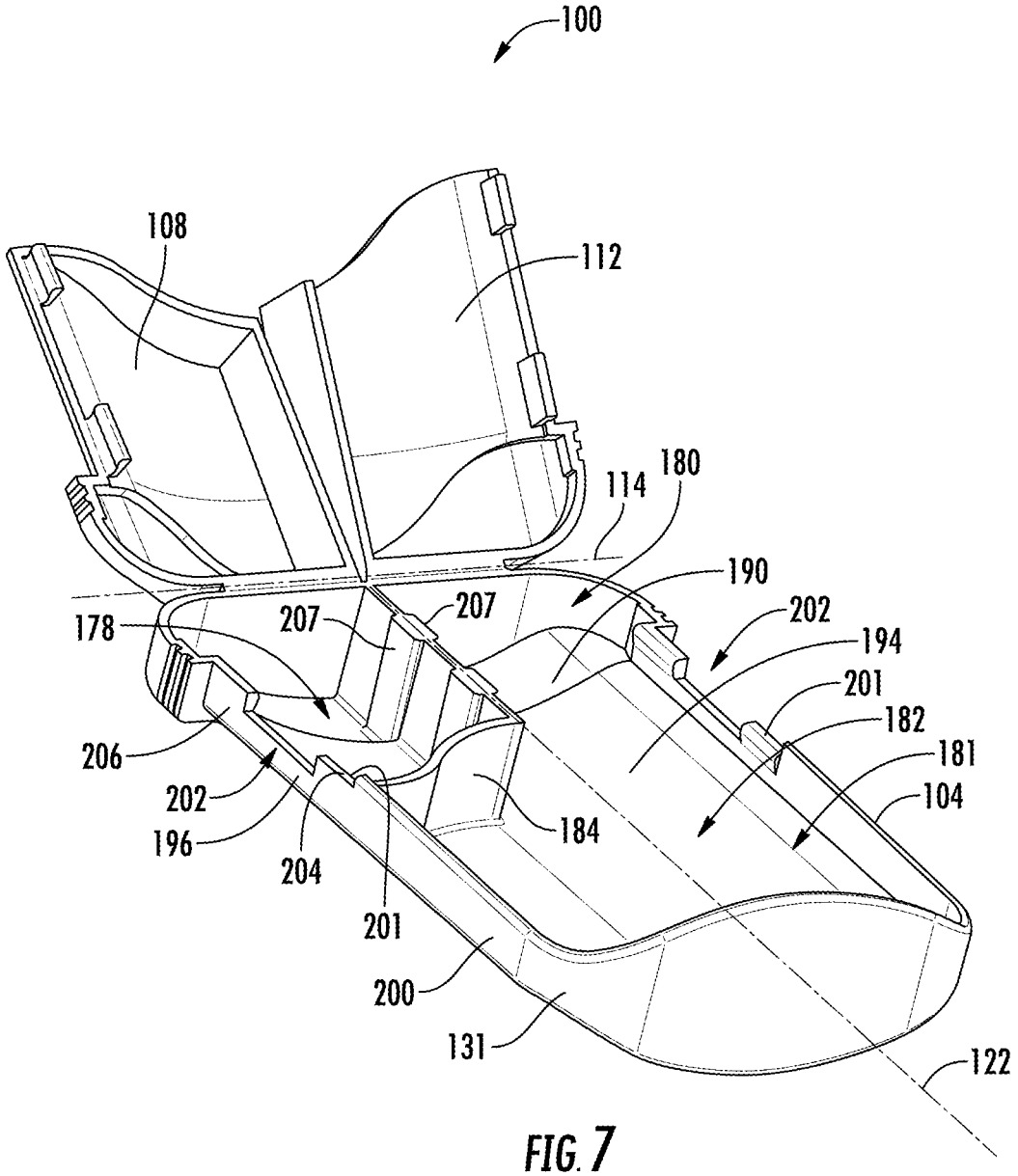
FIG. 7 is an isometric front view of the internal cartridge with the covers attached to the internal cartridge in their open states.

Turning now to FIG. 7, the internal cartridge 104 is shown in an enlarged view to permit a more detailed discussion of the internal cartridge 104. The first cover 108 is open having been rotated a first rotational distance while the second cover 112 is open as well but having been rotated a second rotational distance, less than the first rotational distance, thus illustrating that each of the first and second covers 108, 112 rotate independently of one another.

It can now be fully appreciated that the first portion 180 of the second storage cavity 182 is in fluid communication with a second portion 181 of the second storage cavity 182. However, the first storage cavity 178 is not in fluid communication with the second storage cavity 182 because of the separation provided by the internal wall 184.

In this example, the volume of the second storage cavity 182 is larger than the volume of the first storage cavity 178. This is because the second storage cavity 182 is intended to store bulk product during use (e.g. unused tobacco packets or unused pieces of gum) while the first storage cavity 178 is intended to hold used product (e.g. used tobacco packets or chewed gum until the user can otherwise dispense with the used product). In an example, the volume of the second storage cavity 182 may be at least twice as large as the first storage cavity 178 and in one example may be three times as large.

It can also be seen that the first portion 180 of the second storage cavity 182 is larger in size than the second portion 181 of the second storage cavity 182. This is because the first portion 180 is intended to be used to dispense product when the internal cartridge 104 has been transitioned to the withdrawn position. Thus, the first portion 180 only provides limited access to the entire amount of unused product.

The second cover 112 is hingedly attached to the internal cartridge 104 by the second hinge 114. The second cover 112 pivots between a closed position and an open position about the second hinge 114. With the second cover 112 in the open position, access to the second storage cavity 182 is provided. As noted above, the second cover 112 is attached to the internal cartridge 104 and the length thereof is configured such that the second cover 112 cannot pivot to the open position until the internal cartridge 104 is in the withdrawn position.

It can also now be appreciated, in comparing FIG. 6 with FIG. 5 that the second portion 181 of the second storage cavity 182 remains within the outer shell 102 when the internal cartridge 104 is in the withdrawn position. The first portion 180 of the second storage cavity 182 is external to the outer shell 102 when the internal cartridge 104 is in the withdrawn position. The second cover 112 covers, at least, part of the first portion 180 of the second storage cavity 182 when in the closed position.

With reference to FIG. 7, the internal cartridge 104 includes a bottom 190. A peripheral wall 131 extends outward from an inner side 194 of the bottom 190. The internal wall 184 extends outward from the inner side 194 of the bottom 190. The internal wall 184 cooperates with the peripheral wall 131 to define the first and second storage cavities 178, 182.

In this example, the peripheral wall 131 is a stepped wall that includes a shorter wall portion 196 of the peripheral wall 131 and a taller wall portion 200 of the peripheral wall 131. A step 201 is formed between the shorter wall portion 196 and the taller wall portion 200.

The shorter wall portion 196 includes a top 204. A notches 202 are formed in the top 204 of the shorter wall portion 196. The notches 202 are exposed from an outer side 206 of the peripheral wall 131. The notches 202 allows a user to grip undersides of the first and second covers 108, 112 when transitioning them from their closed positions.

The first storage cavity 178 may be configured, that is sized, to store a few of the products, such as used versions of the product, that are otherwise stored in the larger second storage cavity 182. For example, consider a product that is a snus package. Second storage cavity 182 would store unused snus packages. When out and about without access to a garbage can, the user can store the used snus packages in the first storage cavity 180.

The internal wall 184 may include projections or ribbing 207 to provide support. Further, the top end of the ribbing 207 provides a surface against which the bottom side of the first and second covers 108, 112 can axially abut when in the closed configuration.

Figure 8:
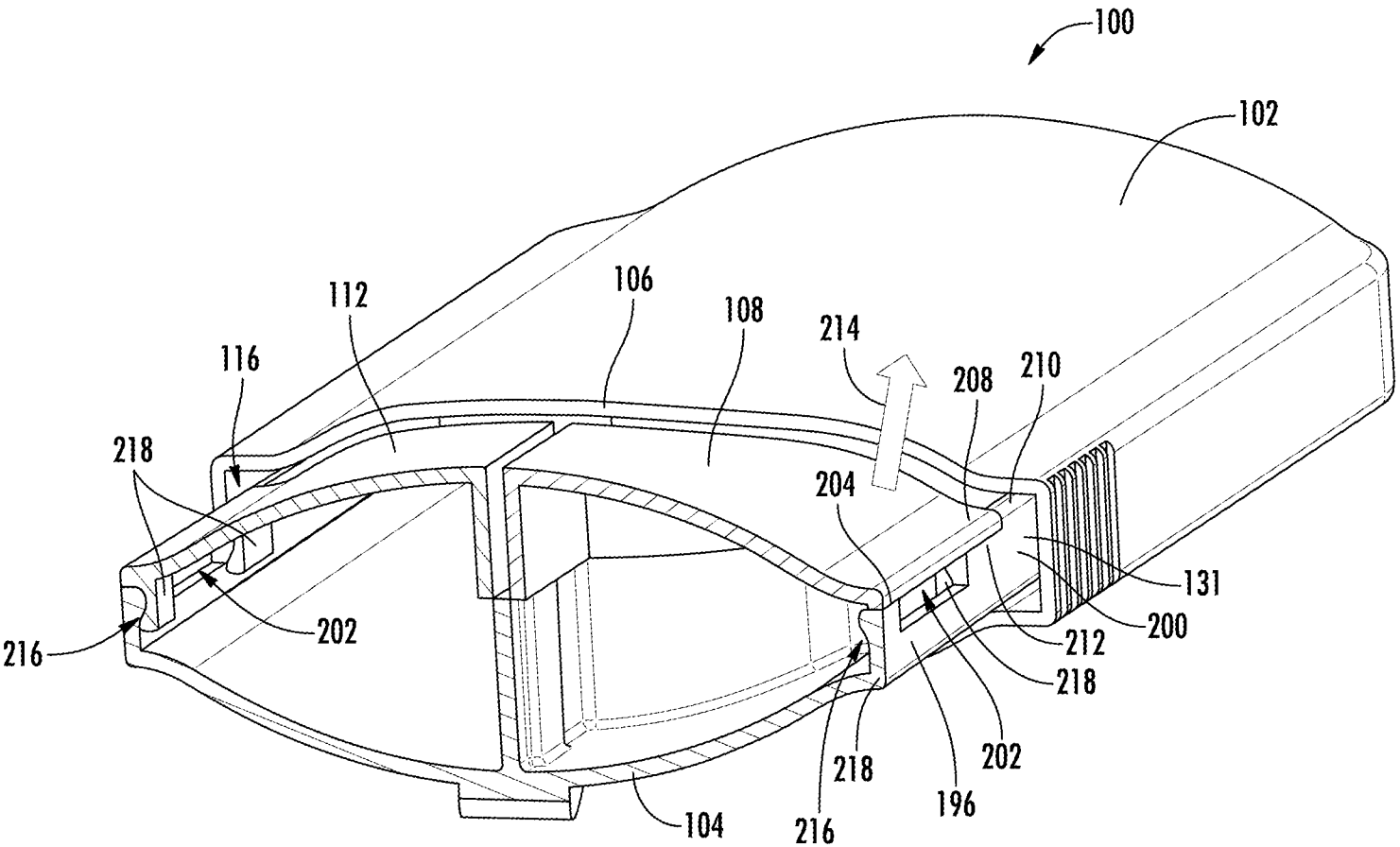
FIG. 8 is an isometric cross-section taken about the line 8-8 in FIG. 2 of the container.

Turning now to FIG. 8, an isometric cross-section taken about the line 8-8 of the container of FIG. 2 is illustrated. The internal cartridge 104 of the container 100 is in the withdrawn position prior to having the covers 108, 112 opened. A catch arrangement 216 having a pair of snaps 218 on each one of the first and second covers 108, 112 permit a snap engagement between the first and second cover 108, 112 and the peripheral wall 130 of the internal cartridge 104.

The first cover 108 has a top surface 208. An edge portion of the top surface 208 aligns with a top 210 of the taller wall portion 200 with a smooth transition therebetween. A bottom side 212 of the first cover 108 abuts a top of the shorter wall portion 196 in the closed position.

In the closed position, the first cover 108 extends over the notch 202. Thus, in the withdrawn position of the internal cartridge 104, as in FIG. 2, the notches 202 on opposite sides of the peripheral wall 131 are accessible to a user such that either or both first and second covers 108, 112 can be opened. The opening can be effectuated, for example, by inserting at least a finger or thumb partially into one or both notches 202 and applying a lifting force 214 to pivot the first or second or both covers 108, 112 to the open position, as seen for example, in FIG. 7. The internal cartridge 104 must be fully sufficiently withdrawn from the opening 116 in order for the first and second covers 108, 112 to pivot to their open positions (e.g. the ends of the covers 108, 112 opposite the hinges must be withdrawn from the outer shell 102). In other words, the entirety of the covers 108, 112 need to be withdrawn from the outer shell 102.

In other example, it is contemplated that the first and second covers 108, 112 could open away from one another. Again, the entirety of the covers would need to be withdrawn from the outer shell 102 to permit opening. In such an example, the hinges of the covers would be parallel, but the covers would be positioned between the pair of hinges. These hinges would be generally parallel to sliding axis 122.

Figure 9:
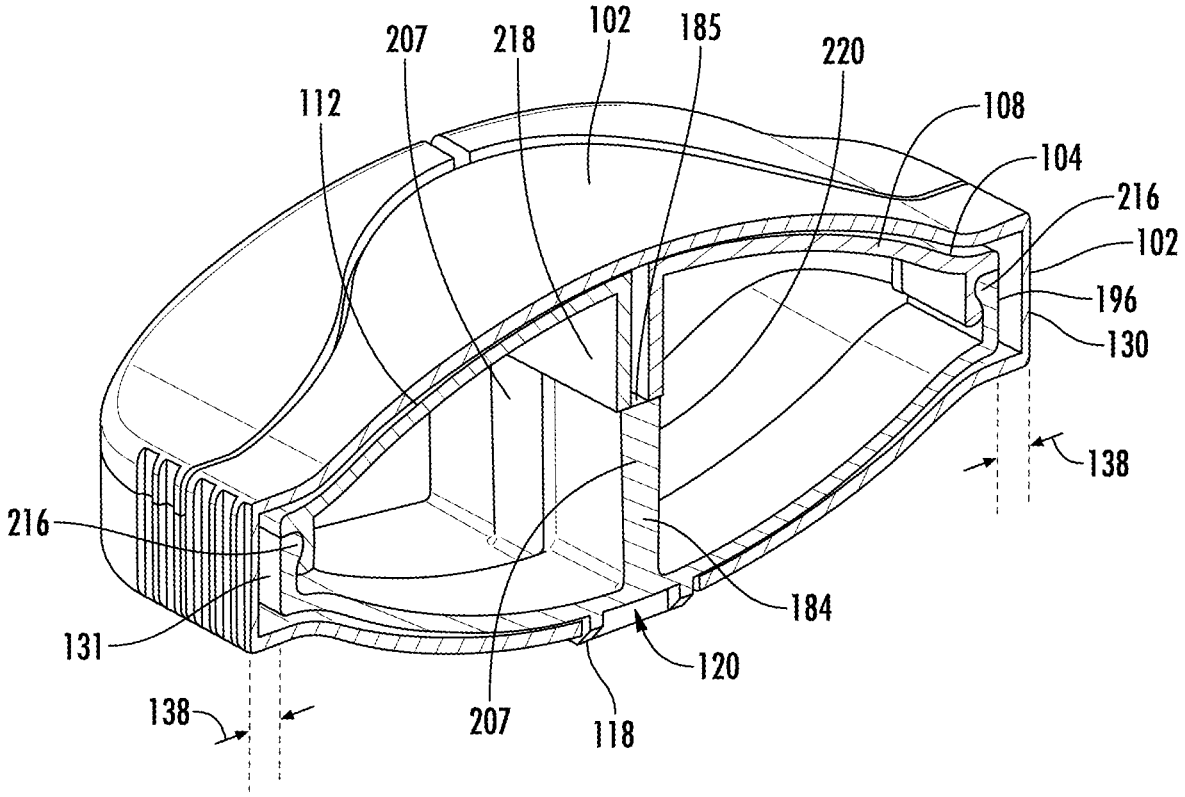
FIG. 9 is a cross-section taken about the line 9-9 of the container of FIG. 1.

FIG. 9 is a cross-section taken about the line 9-9 of the container of FIG. 1. In this view, it can be readily appreciated that the first and second covers 108, 112 close over portions of the internal cartridge 104 such that they are able to slide under the outer shell 102 abutment end 106 as the internal cartridge 104 transitions between the inserted and withdrawn states. Accordingly, the internal cartridge 104 is slideable within the outer shell 102.

A first leg portion 218 of the first cover 108 contacts a top 185 of the internal wall 184, and particularly ribbing 207, when the first cover 108 is in the closed position. A second leg portion 220 of the second cover 112 contacts the top 185 of the internal wall 184, and particularly ribbing 207 on the other side, when the second cover 112 is in a closed positon, as it is in FIG. 8. The catch arrangements 216 are resiliently snap engaged with the shorter wall portions 196 of the internal cartridge 104.

As previously discussed, the gaps 138 between the internal cartridge 104 and the peripheral wall 130 permit the squeezing deformation of the outer shell 102. The squeezing deformation permits the internal cartridge 104 to be pulled to a withdrawn position as the catch 118 of the internal cartridge 104 is withdrawn from the opening 120 through which it had been attached to the outer shell 102. Pushing the internal cartridge into the outer shell 102 re-engages the catch 118 with the outer shell 102 to prevent the internal cartridge 104 from sliding open until the squeezing pressure is applied to the outer shell 102 and the pulling force is applied to the internal cartridge 104.

From the aforementioned description, it should be readily apparent that the user must slide the internal cartridge and attached covers 108, 112 sufficiently far to allow opening of the covers 108, 112.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the present disclosure (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the present disclosure and does not pose a limitation on the scope of the present disclosure unless otherwise claimed. No language in the specification should be construed as indicating any non-claimed element as essential to the practice of the present disclosure.

Preferred examples of this present disclosure are described herein, including the best mode known to the inventors for carrying out the present disclosure. Variations of those examples may become apparent to those of ordinary skill in the art upon reading the foregoing description. The inventors expect skilled artisans to employ such variations as appropriate, and the inventors intend for the present disclosure to be practiced otherwise than as specifically described herein. Accordingly, the present disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A child proof container comprising:

an outer shell defining an opening;

an internal cartridge defining first and second storage cavities, the internal cartridge slidable within the outer shell between an inserted position and a withdrawn position;

a first cover hingedly attached to the internal cartridge by a first hinge, the first cover pivoting about the first hinge between a closed position for covering the first storage cavity and an open position for providing access to the first storage cavity, the first cover being attached to the internal cartridge such that the first cover cannot pivot to the open position until the internal cartridge is in the withdrawn position; and wherein only a portion of the first cover is received in the outer shell when the first cover is in the closed position and the internal cartridge is in the inserted position, the first cover and outer shell configured to prevent entirely inserting the first cover into the outer shell.

2. A child proof container comprising:

an outer shell defining an opening;

an internal cartridge defining first and second storage cavities, the internal cartridge slidable within the outer shell between an inserted position and a withdrawn position;

a first cover hingedly attached to the internal cartridge by a first hinge, the first cover pivoting about the first hinge between a closed position for covering the first storage cavity and an open position for providing access to the first storage cavity, the first cover being attached to the internal cartridge such that the first cover cannot pivot to the open position until the internal cartridge is in the withdrawn position; and a second cover hingedly attached to the internal cartridge by a second hinge, the second cover pivoting between a closed position and an open position about the second hinge, the open position providing greater access to the second storage cavity than the closed position, the second cover being attached to the internal cartridge such that the second cover cannot pivot to the open position until the internal cartridge is in the withdrawn position.

3. The child proof container of claim 2, wherein the first cover is received, at least in part, within the outer shell when the first cover is in the closed position and the internal cartridge is in the inserted position.

4. The child proof container of claim 2, further comprising a stop arrangement between the outer shell and the internal cartridge, the stop arrangement limiting the amount of relative sliding travel between the outer shell and the internal cartridge, the stop arrangement defining the withdrawn position whereat the first cover may be transitioned from the closed position to the open position.

5. The child proof container of claim 2, wherein the first hinge is external of the outer shell when the internal cartridge is in the inserted position with the first cover received within the outer shell.

6. The child proof container of claim 2, wherein the internal cartridge is slidable within the outer shell along a sliding axis, the first hinge being substantially perpendicular to the sliding axis.

7. The child proof container of claim 6, wherein the internal cartridge includes a bottom and a peripheral wall extending outward from an inner side of the bottom, the internal cartridge includes an internal wall extending outward from the inner side of the bottom, the internal wall cooperating with the peripheral wall to define the first and second storage cavities.

8. The child proof container of claim 7, wherein the first cover and internal cartridge include a catch arrangement that snap engages to secure the first cover in the closed position when the internal cartridge is in the withdrawn position.

9. The child proof container of claim 8, wherein the first cover abuts a top of the internal wall portion in the closed position.

10. The child proof container of claim 2, wherein the first and second hinges are co-axial.

11. The child proof container of claim 2, wherein the outer shell includes a sidewall defining an abutment end, the abutment end defining the opening of the outer shell, the internal cartridge and first and second covers defining a cartridge abutment that abuts the abutment end of the outer shell when the internal cartridge is in the inserted position and the first and second covers are in the closed position.

12. The child proof container of claim 11, wherein the abutment end of the outer shell and cartridge abutment define an interface, an outer periphery of the abutment end and an outer periphery of the cartridge abutment being the same such that the outer periphery of the abutment end transitions into the outer periphery of the cartridge abutment.

13. The child proof container of claim 2, wherein a volume of the first storage cavity is smaller than the second storage cavity.

14. The child proof container of claim 2, wherein the second storage cavity has a first portion that remains within the outer shell when the internal cartridge is in the withdrawn position and a second portion that is external to the outer shell when the internal cartridge is in the withdrawn position, the second cover covering, at least part, of the first portion of the second storage cavity when in the closed position, the first portion of the second storage cavity in direct fluid communication with the second portion of the second storage cavity when the second cover is in the closed position, such that product within the second portion of the second storage cavity can transition from the second portion to the first portion when the second cover is in the closed position.

15. A child proof container comprising:

an outer shell defining an opening;

an internal cartridge defining first and second storage cavities, the internal cartridge slidable within the outer shell between an inserted position and a withdrawn position;

a first cover hingedly attached to the internal cartridge by a first hinge, the first cover pivoting about the first hinge between a closed position for covering the first storage cavity and an open position for providing access to the first storage cavity, the first cover being attached to the internal cartridge such that the first cover cannot pivot to the open position until the internal cartridge is in the withdrawn position;

wherein the internal cartridge is slidable within the outer shell along a sliding axis, the first hinge being substantially perpendicular to the sliding axis; and wherein the internal cartridge includes a bottom and a peripheral wall extending outward from an inner side of the bottom, the internal wall extending outward from the inner side of the bottom, the peripheral wall having a step separating a shorter wall portion of the peripheral wall from a taller wall portion of the peripheral wall, the first cover having a top surface, the top surface aligning with a top of the taller wall portion, a bottom side of the first cover abutting a top of the shorter wall portion.

16. The child proof container of claim 15, wherein the shorter wall portion includes a notch formed in the top thereof, the notch exposed from an outer side of the peripheral wall, the first cover extending over the notch.

* * * * *